US012215482B2

(12) United States Patent
Gelmini et al.

(10) Patent No.: US 12,215,482 B2
(45) Date of Patent: Feb. 4, 2025

(54) IMPLEMENTS ELECTRONIC POWER LIMITATION

(71) Applicant: DANA ITALIA S.R.L., Trentino (IT)

(72) Inventors: Mario Gelmini, Arco (IT); Lorenzo Dalla Palma, Arco (IT); Giovanni Profumo, Arco (IT)

(73) Assignee: DANA ITALIA S.R.L., Arco (IT)

( * ) Notice: Subject to any disclaimer, the term of this patent is extended or adjusted under 35 U.S.C. 154(b) by 393 days.

(21) Appl. No.: 17/663,168

(22) Filed: May 12, 2022

(65) Prior Publication Data

US 2023/0366176 A1 Nov. 16, 2023

(51) Int. Cl.
*E02F 9/22* (2006.01)
*E02F 9/20* (2006.01)

(52) U.S. Cl.
CPC ..... *E02F 9/2203* (2013.01); *E02F 9/2004* (2013.01); *E02F 9/2271* (2013.01)

(58) Field of Classification Search
CPC ..... E02F 9/2203; E02F 9/2004; E02F 9/2271; E02F 9/2066; E02F 3/283; E02F 9/2228; E02F 9/2246; E02F 3/43; G05B 19/04
See application file for complete search history.

(56) References Cited

U.S. PATENT DOCUMENTS

| | | | | |
|---|---|---|---|---|
| 6,950,735 | B2 | 9/2005 | Kilworth et al. | |
| 8,756,930 | B2 | 6/2014 | Johnson et al. | |
| 8,970,075 | B2 | 3/2015 | Rippel et al. | |
| 10,284,047 | B2 | 5/2019 | Fritts et al. | |
| 2008/0104954 | A1 | 5/2008 | Schifferer et al. | |
| 2015/0139767 | A1 | 5/2015 | Moriki et al. | |
| 2016/0237651 | A1 | 8/2016 | Miyamoto et al. | |
| 2017/0198768 | A1 | 7/2017 | Vora et al. | |
| 2020/0123740 | A1 | 4/2020 | Oasa | |
| 2020/0350796 | A1 | 11/2020 | Yang et al. | |
| 2021/0276848 | A1* | 9/2021 | Miller | B66F 9/07554 |

FOREIGN PATENT DOCUMENTS

WO 2005057757 A1 6/2005

* cited by examiner

*Primary Examiner* — Rodney A Butler
(74) *Attorney, Agent, or Firm* — McCoy Russell LLP

(57) ABSTRACT

Methods and systems for operating implements of a vehicle are described. Operation of the implements may be adjusted in response to input to a human/machine interface, such as a joystick. In one example, one or more implement requests are scaled according to a human/machine allowance factor, where the human/machine allowance factor is based on an implements power limit and an implements requested power.

16 Claims, 6 Drawing Sheets

IMPLEMENTS ELECTRONIC POWER LIMITATION

TECHNICAL FIELD

The present disclosure relates to a vehicle system that includes implement controls with propulsion controls.

BACKGROUND AND SUMMARY

A vehicle may include one or more implement controls that provide power to devices that do not operate to propel the vehicle. For example, a vehicle may include implement controls for adjusting boom angle, bucket angle, and an extension distance of a telescopic boom. These implement controls may include one or more hydraulic valves and a hydraulic pump that provides motive force to hydraulic fluid. The hydraulic pump may supply pressurized hydraulic fluid to actuators and hydraulic cylinders that may adjust operation of each of the implements according to input to a human machine interface (e.g., a joystick) by a vehicle operator. The vehicle operator may request that power be delivered to more than one of the implements simultaneously, and there may be instances when it may be possible for the operator to request power to operate implements that may be sufficient to stall an engine that provides torque to rotate the hydraulic pump. In addition, the power that the vehicle operator requests through the human machine interface to control the implements may be in addition to a power request to propel the vehicle. Therefore, it may be possible for operation of implements to affect power that is applied to propel the vehicle.

To address at least a portion of the abovementioned issues, the inventors herein have developed a vehicle system. The vehicle system includes a human/machine interface; a plurality of implement actuators; and a controller including instructions stored in non-transitory memory that when executed cause the controller to adjust an amount of power delivered to one or more of the plurality of implement actuators in response to an amount of power requested to operate the plurality of implement actuators as requested via input to the human/machine interface.

By adjusting the amount of power that is delivered to one or more of the plurality of implement actuators in response to an amount of power that is requested to operate the plurality of implement actuators as requested via input to the human/machine interface, it may be possible to provide the technical result of limiting power to operate implements so that an engine may not become overloaded. Further, in some examples, the amount of power that is delivered to the one or more of the plurality of implement actuators may be limited in response to a transmission power request so that vehicle propulsion maybe maintained even if implement use is requested at a same time as vehicle propulsion is requested.

The present description may provide several advantages. In particular, the approach may reduce a possibility of engine stalling. Further, the approach allows for a priority of operating implements to be assigned by a power manager so that operation of select vehicle functions may be maintained. In addition, the approach may provide additional functionality without increasing system hardware cost.

It is to be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
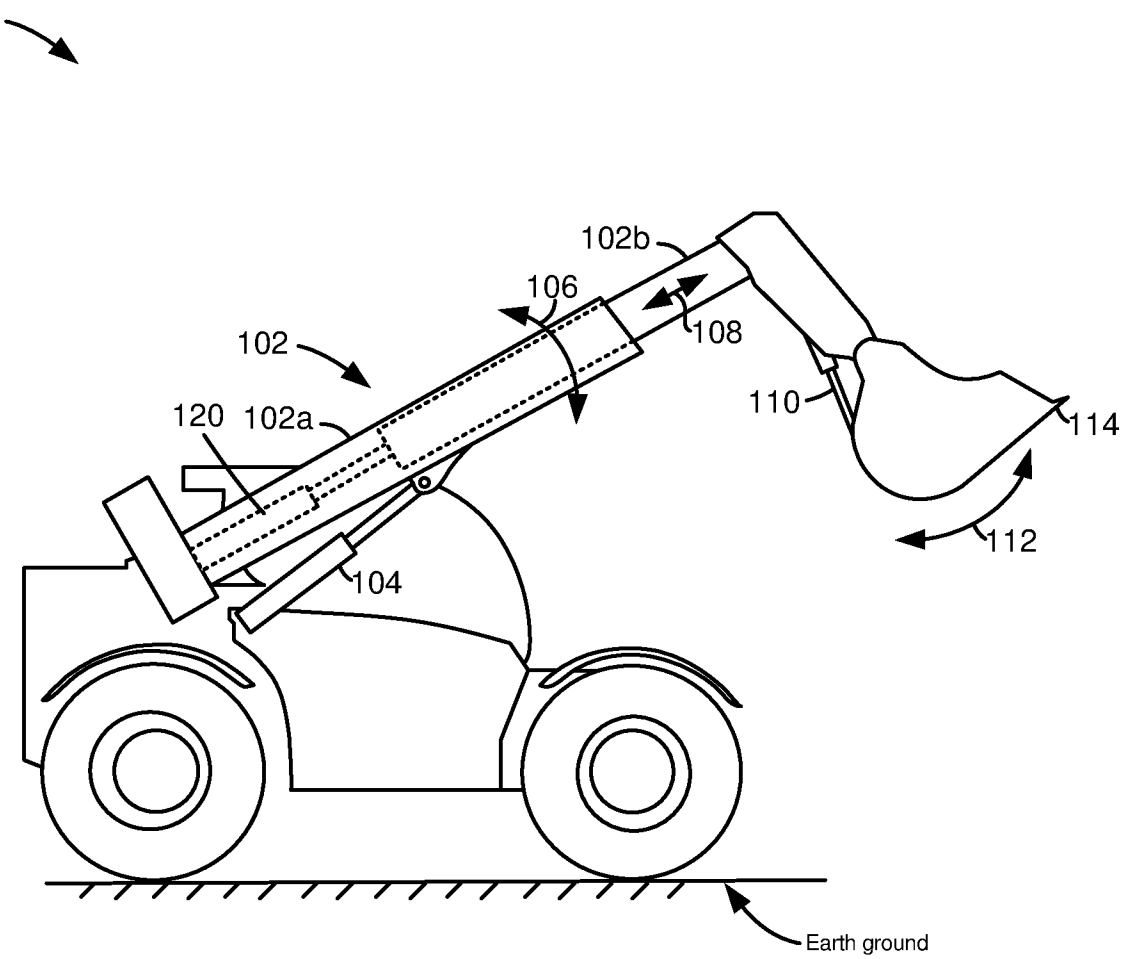
FIG. 1 is an illustration of an example vehicle that includes a plurality of implements.
Figure 2:
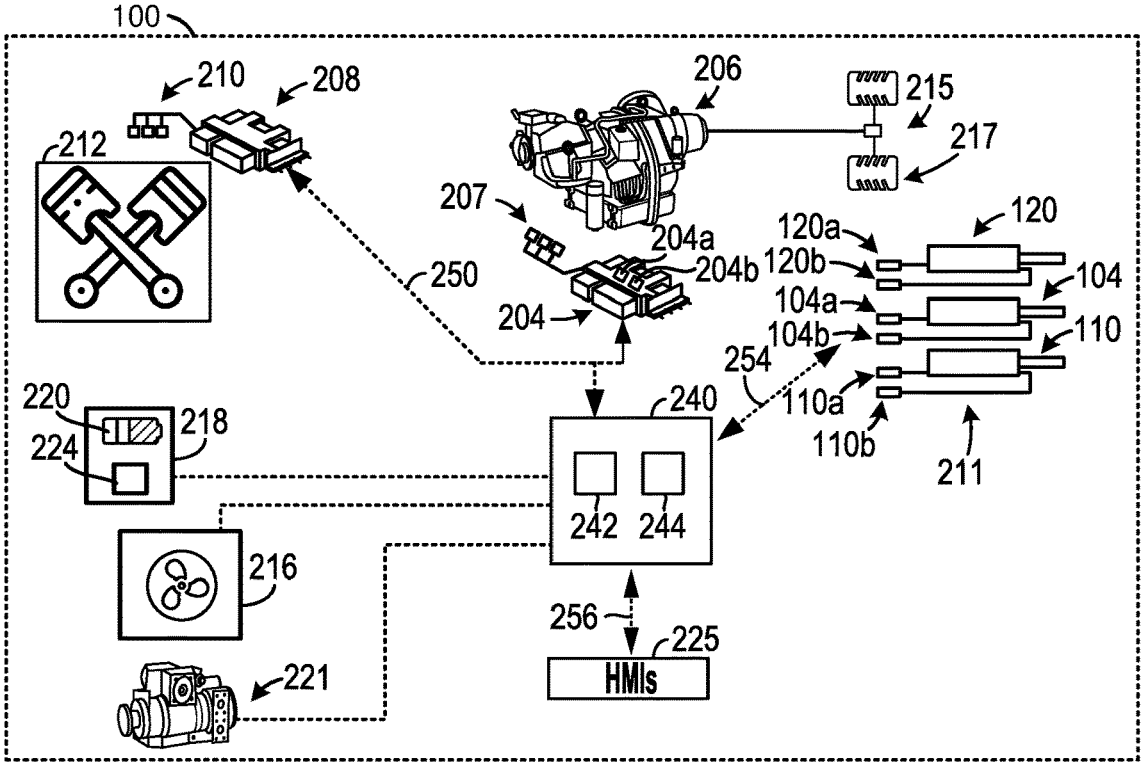
FIG. 2 is an illustration of a system for controlling a vehicle that includes implements and a propulsion source.
Figure 3:
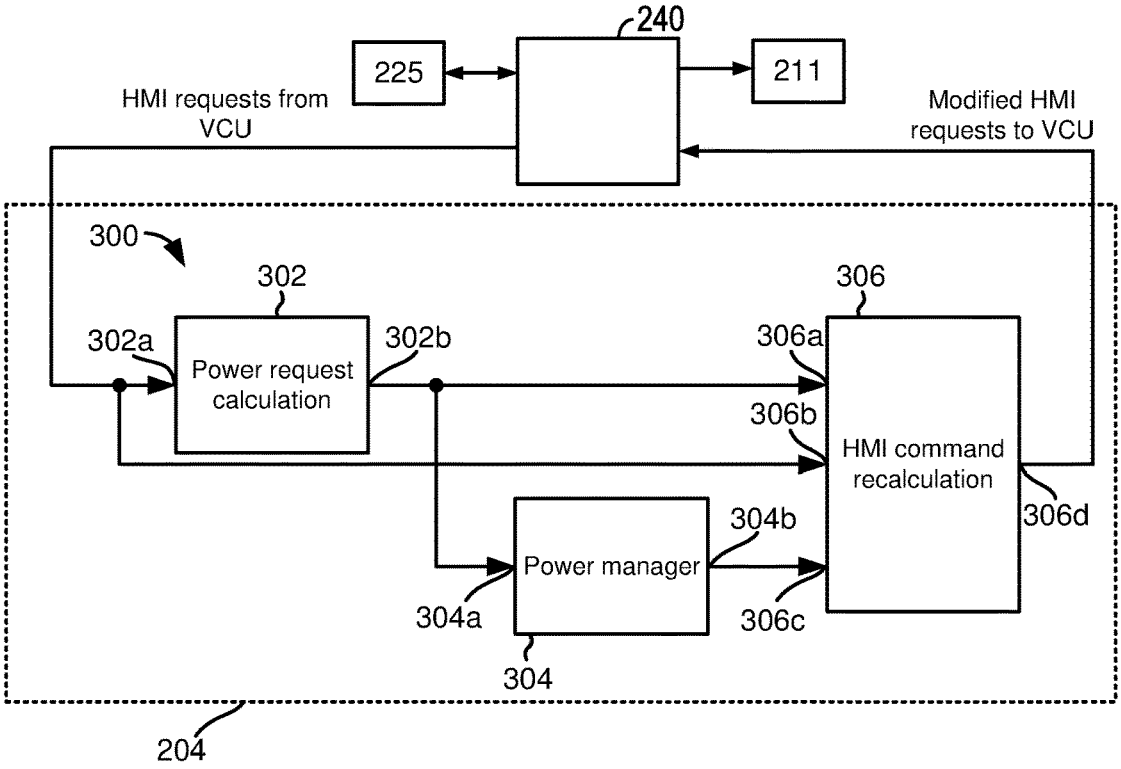
FIG. 3 is a block diagram of a method for operating a plurality of implements in response to input to a human/machine interface.
Figure 4:
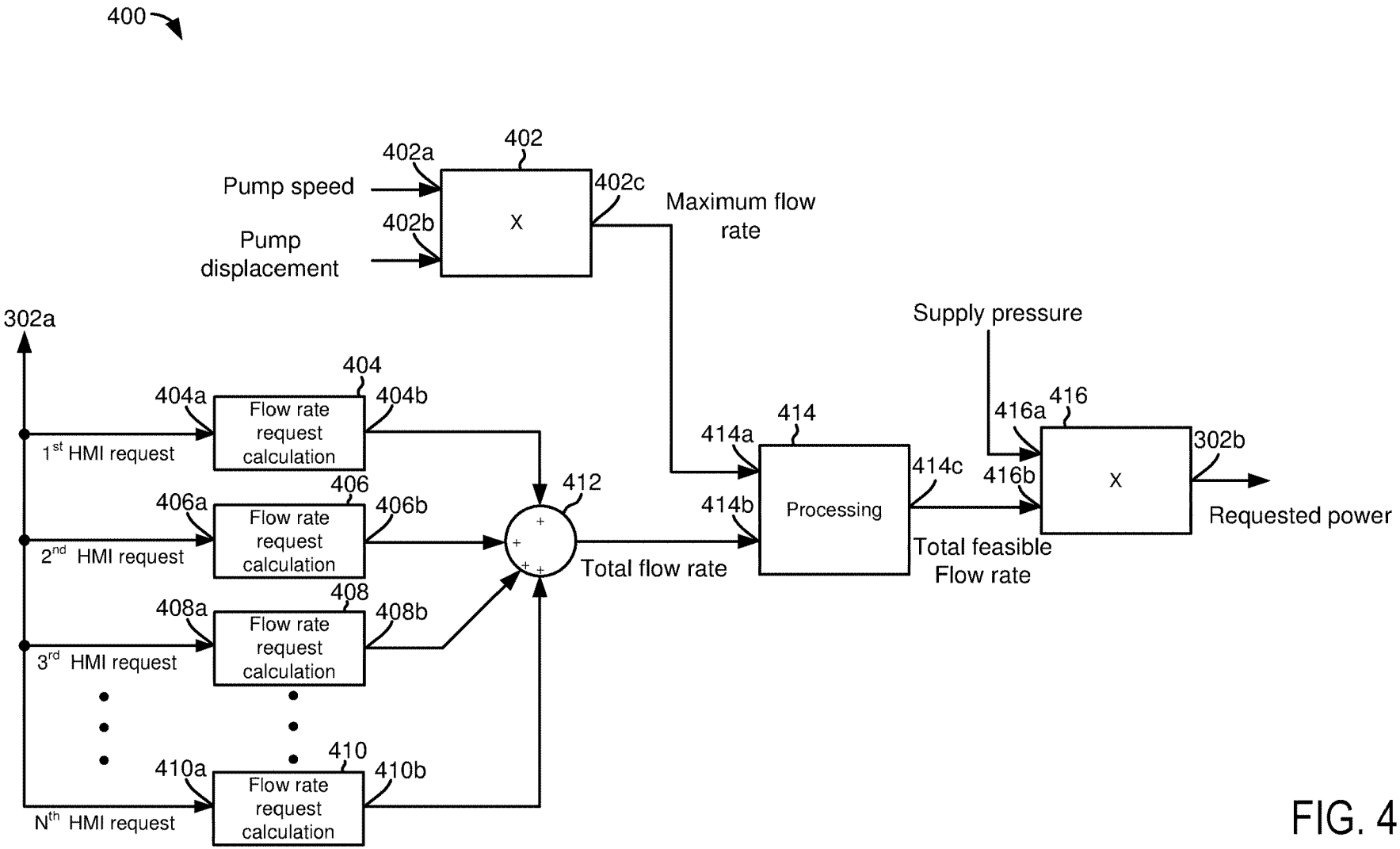
FIG. 4 is a block diagram of a method to generate requested power for implements of a vehicle.
Figure 5:
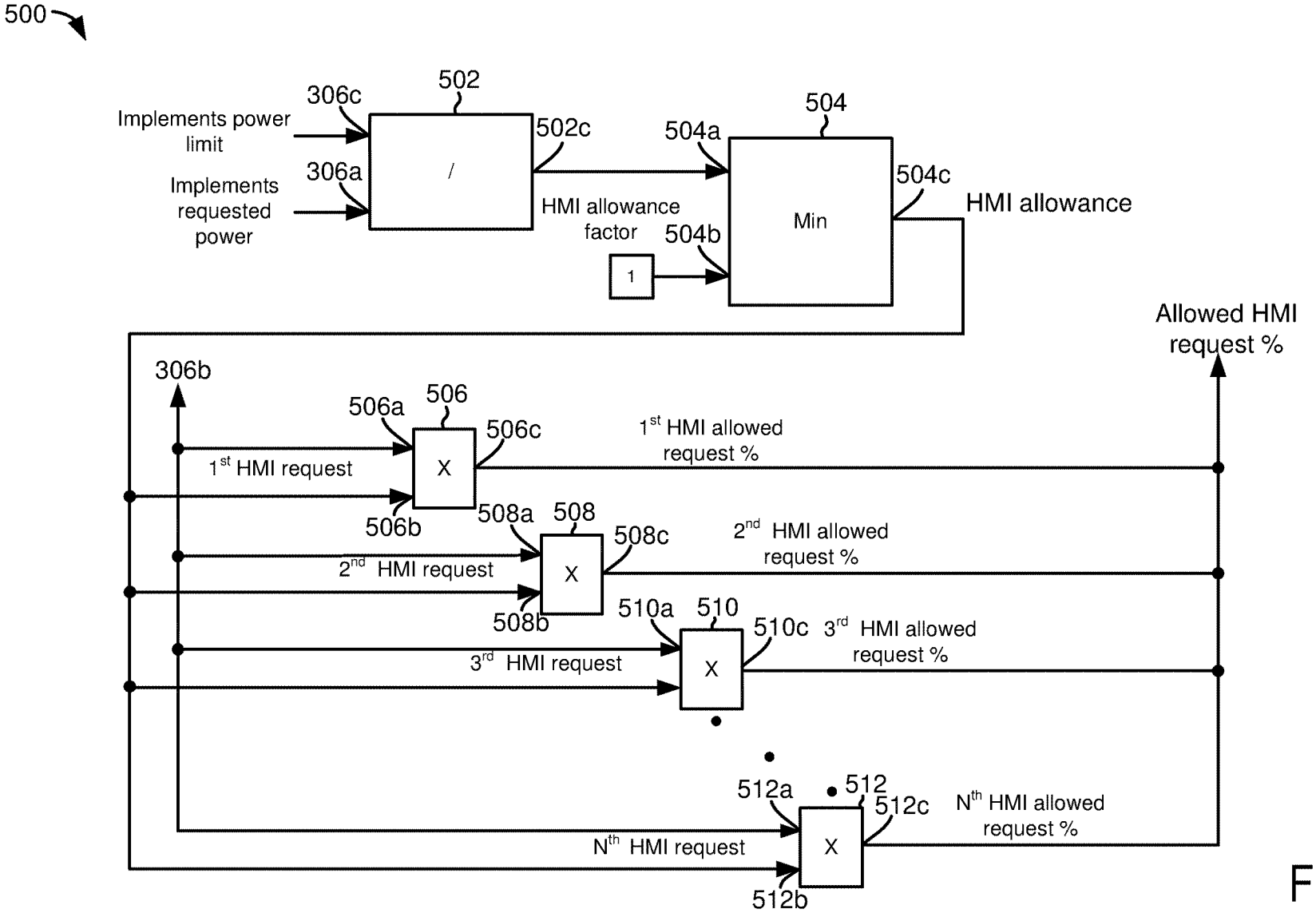
FIG. 5 is a block diagram of a method to adjust implement requests according to an implements power limit and the requested power for the implements.
Figure 6:
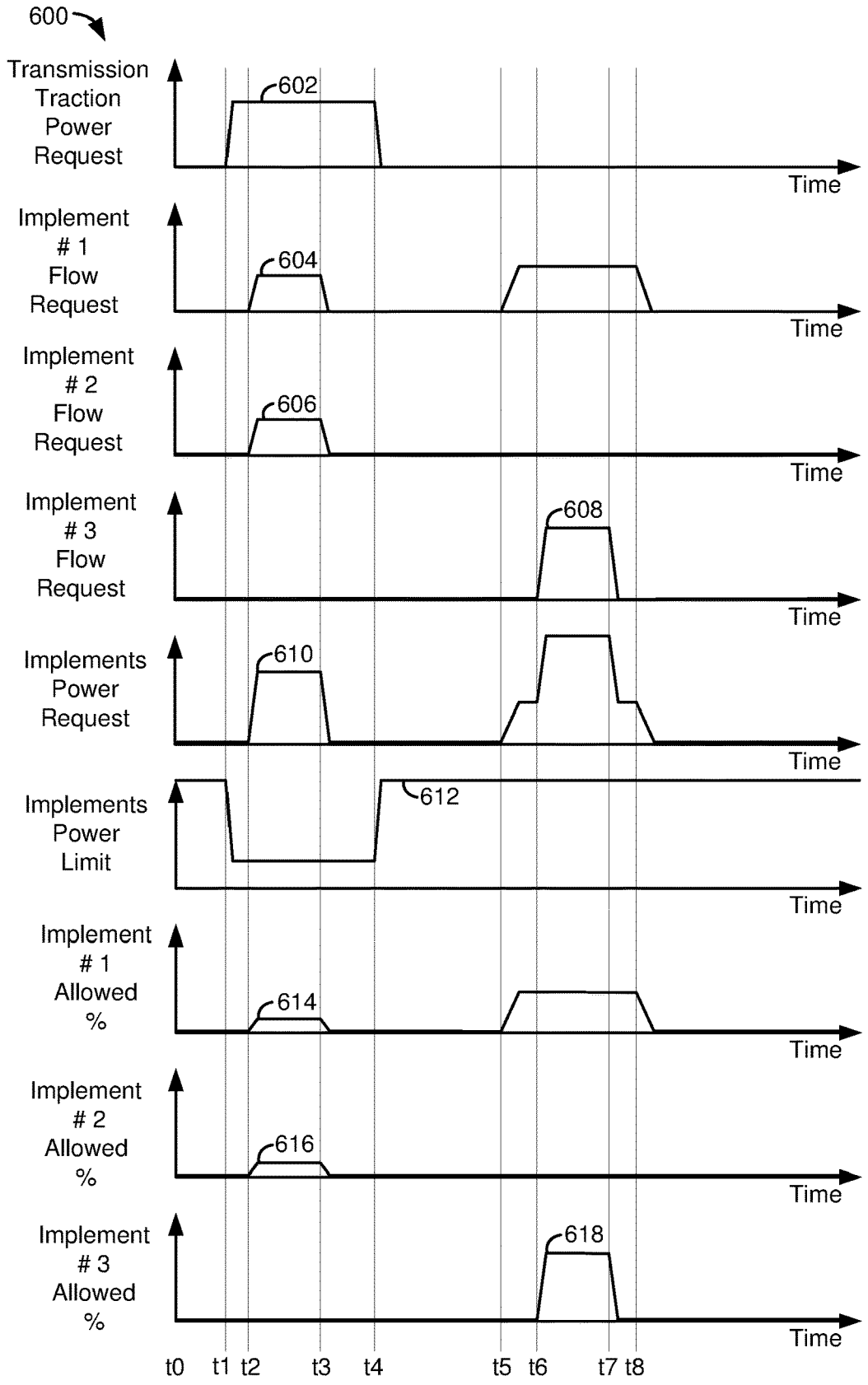
FIG. 6 shows plots of an example vehicle operating sequence according to the method described herein.
Figure 7:
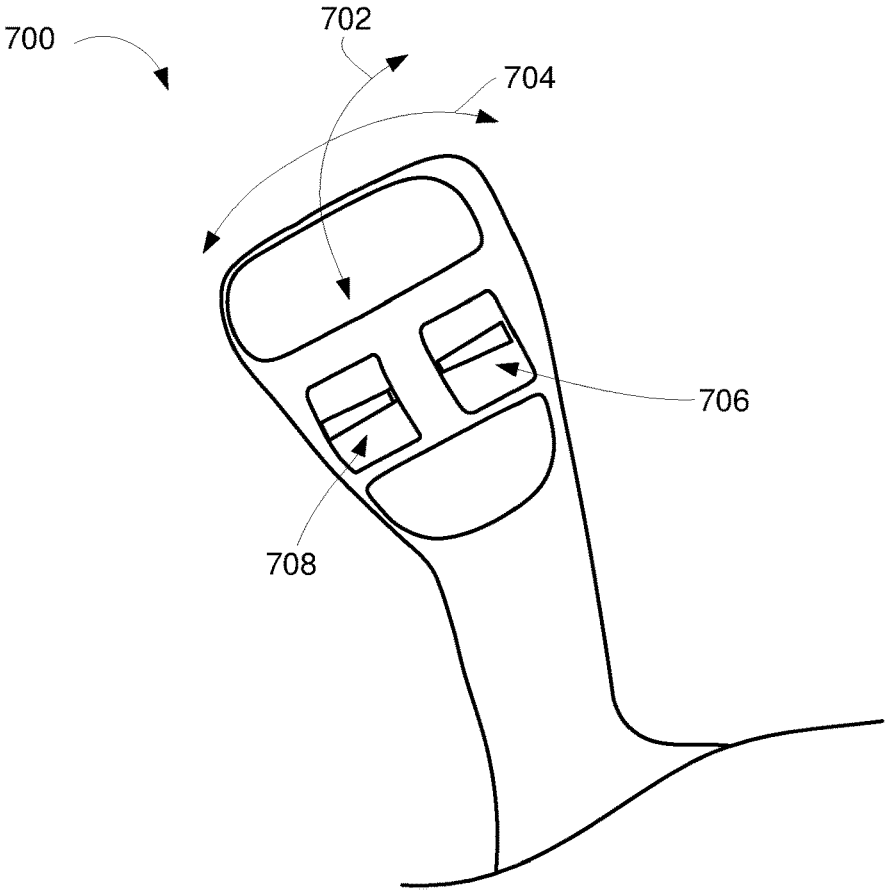
FIG. 7 is an illustration of an example joystick.
Figure 8:
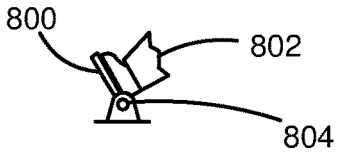
FIG. 8 is an illustration of an example driver demand pedal.
Figure 9:
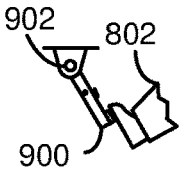
FIG. 9 is an illustration of an example brake pedal.

A method and system for regulating power delivery to implements of a propelled vehicle is described herein. The method and system may allocate power delivery to implements as a function of requested power for propulsive effort so that propulsive effort may be maintained while operation of implements is requested. Power delivery to the vehicle's implements may be limited so as to reduce a possibility of engine stalling. An example vehicle that includes a single power source for propulsion and implements is shown in FIG. 1. A block diagram that illustrates vehicle systems including controls is shown in FIG. 2. A high level block diagram that illustrates how human/machine interface power requests may be processed is shown in FIG. 3. A block diagram that illustrates how an aggregate human/machine interface power request is determined is shown in FIG. 4. A block diagram that illustrates how individual human/machine power requests may be processed is shown in FIG. 5. An example operating sequence according to the methods described in the block diagrams of FIGS. 3-5 is shown in FIG. 6. Finally, example human/machine interfaces are shown in FIGS. 7-9.

FIG. 1 shows an illustration of a vehicle 100 that includes implements that are powered via a power source that also powers the vehicle's propulsion. In this example, vehicle 100 is configured as a wheeled loader, but in other examples vehicle 100 may be configured as a dozer, earth mover, excavator, back hoe, or other vehicle that includes implements. Further, in some examples, the vehicle may include tracks instead of wheels. The vehicle 100 may be an off-highway vehicle, in one example, although on-highway vehicles have also been envisioned. Industries and the corresponding operating environments in which vehicle 100 may be deployed include forestry, mining, agriculture, construction, oil and gas, and the like.

Vehicle 100 is shown with a telescopic boom 102 that may extend and retract as indicated by arrows 108. Telescopic boom includes an outer arm 102*a* and an inner arm 102*b*. Inner arm 102*b* may slide in and out of outer arm 102*a* as indicated by arrows 108. Inner arm 102*b* may be extended or retracted as indicated by arrows 108 via hydraulic cylinder 120 (e.g., an actuator). The angle of telescopic boom relative to earth ground may be adjusted via hydraulic cylinder 104 (e.g., an actuator) as indicated by arrows 106. Telescopic boom 102 also includes a bucket 114. A position of bucket 114 may be adjusted as indicated by arrows 112 via hydraulic cylinder 110 (e.g., an actuator). Telescopic boom 102 may also include a second outer arm (not shown) and a second inner arm (not shown) that are configured similarly to outer arm 102*a* and inner arm 102*b*. The second outer arm and the second inner arm may be arranged in parallel with the outer arm 102*a* and inner arm 102*b* so that loads of telescopic boom 102 may be shared via the two outer arms.

Referring now to FIG. 2, a depiction of vehicle 100 is shown with several of its systems. In particular, the vehicle's power source 212, transmission 206, and implement actuation system 211 are shown. In this example, vehicle 100 shows a distributed system architecture where a plurality of controllers are configured to operate vehicle 100. In other examples, vehicle 100 may include a single controller or a controller architecture that is different than that shown in FIG. 2. For example, in some examples, transmission control unit 204 may be included in vehicle control unit 240. As such, the system architecture shown in FIG. 2 is not to be construed as limiting the present description.

The vehicle 100 includes a power source (e.g., an engine) 212. The power source 212 may be an internal combustion engine designed for compression ignition and/or spark ignition. For instance, in one example, the power source 212 may be a compression ignition engine configured to combust diesel fuel. The engine may additionally or alternatively be designed to combust other suitable fuels such as gasoline, biodiesel, alcohol blends, and the like. As such, the engine may include conventional components to carry out cyclical combustion operation such as one or more cylinders, an intake system, an exhaust system, a fuel delivery system, and the like. Alternatively, power source may be an electric machine.

The vehicle 100 further includes a transmission 206 mechanically coupled to the power source 212. In one example, the transmission 206 may be a hydromechanical variable transmission (HVT). For instance, the transmission may function as an infinitely variable transmission (IVT) where the transmission's gear ratio is controlled continuously from a negative maximum speed to a positive maximum speed with an infinite number of ratio points. In this way, the transmission can achieve a comparatively high level of adaptability and efficiency relative to transmissions which operate in discrete ratios. Alternatively, the transmission 206 may be another type of continuously variable transmission (CVT) capable of seamlessly shifting through a continuous range of gear ratios, such as a hydrostatic CVT that uses a variable displacement pump and a hydraulic motor, for instance. Other suitable automatic transmissions such as dual-clutch transmissions (DCTs) that employ two input clutches, may be used, in the vehicle, in other examples.

The vehicle 100 further includes implement actuators, such as hydraulic cylinder 120, hydraulic cylinder 104, and hydraulic cylinder 110. Implement actuators may be supplied with hydraulic power via pump 221. Pump 221 may be driven via a power take off (PTO) that is part of transmission 206. The implement actuators may move or operate implements that may include, but are not limited to a hydraulically powered boom, a bed lift, a lift mast assembly, a winch, and the like.

The transmission 206 may further be coupled to a drive axle 215 and wheels 217. The drive axle 215 and wheels 217 may be referred to as a traction system.

The vehicle 100 may further include one or more auxiliary components 216 and/or auxiliary systems 218. The auxiliary systems 218 may include an energy accumulator 220 (e.g., a hydraulic accumulator), a retarder 224 (e.g., an engine brake), and the like. The auxiliary components 216 may include an alternator, a water pump, a fan drive, a brake pump, etc. Generally, the auxiliary system(s) 218, during certain conditions, may receive excess power from the engine and use (e.g., waste) or store the excess energy. The auxiliary components 216 and/or auxiliary systems 218, when in operation, may receive power from the power source 212.

Vehicle 100 includes a vehicle control unit (VCU) 240 to coordinate and efficiently balance power flow in the system. The VCU 240 as well as the other control units described herein may include a processor 242 and memory 244. The memory 244 may include instructions stored therein that when executed by the processor 242 cause the VCU 240 to perform the methods, control techniques, etc., described herein. The VCU 240 may include additional signal processing types of circuits. The memory 244 may include known data storage mediums such as random access memory, read only memory, keep alive memory, combinations thereof, etc. Further, the hardware of the VCU 240 may be collocated in a common enclosure, in one example. Alternatively, the hardware may be included in two or more housings that may be located in different areas of the vehicle. The other control units described herein may be constructed similarly with regard to memory and processors as well as the enclosures that house the control unit hardware.

The VCU 240 may receive data in the form of signals from other control units in the vehicle via controller area network 250 or other communication channels. Specifically, the VCU 240 may interact with other electronic controllers in the vehicle system to receive information related to power flow between different components. As such, the VCU 240 may receive operating conditions data (e.g., engine speed, engine power, available engine power, implements power demands, etc.) that is relayed through the other control units and/or directly from vehicle sensors, systems, components, devices, and the like. VCU 240 may be designed to control adjustment of the auxiliary components 116, auxiliary systems 218, and pump 221. Additionally, the VCU 240 may provide a method for calculating uncontrollable power absorption of the vehicle auxiliary components 216 and/or auxiliary systems 218 at the current (e.g., real-time) system conditions.

The VCU 240 may also be designed to control adjustment of the implements. For example, the VCU 240 may control extension and retraction of a boom 102 via adjusting operation of distributors (e.g. hydraulic flow control valves) 120*a*, 120*b*, 104*a*, 104*b*, 110*a*, and 110*b* via communications link 254. The distributors and hydraulic cylinders are included in implement actuation system 211. Additionally, the VCU 240 may provide a method that estimates the power absorption of a pump 221. To elaborate, in one specific example, the VCU 240 may carry out the method for estimating the power absorption of the pump 221.

The vehicle 100 may also include other control units such an engine control unit (ECU) 208. The ECU 208 may be designed to adjust engine operation such as increasing or decreasing engine torque, engine speed, etc. via adjustment of a throttle, fuel injection, etc. ECU 208 may sense engine conditions via engine sensors 210 (e.g., engine speed sensor, engine air flow sensor, engine temperature sensor, etc.). Further, the ECU 208 may provide a method for calculating a net available power at the current (e.g., real-time) system conditions for power source 212.

A transmission control unit 204 (TCU) may also be included in vehicle 100. TCU is designed generate operating data for the transmission 206 such as transmission gear ratio, losses, clutch configuration, hydrostatic pump configuration (e.g., pump swivel angle), input and output shaft speed, and the like. In addition, TCU includes a processor 204*a* and memory 204*b*, which may be similar as the processor and memory of VCU 240. TCU 204 may control operation of transmission 206 via transmission sensors and actuators 207 (e.g., transmission control solenoids, transmission speed sensors, transmission temperature sensors, etc.). In one example, TCU 204 may receive human/machine interface (HMI) requests from VCU 240. TCU 204 may process the HMI requests and return modified HMI requests to VCU 240. VCU 240 may operate implements via sending control commands to distributors (e.g., 120*a*, 120*b*, 104*a*, 104*b*, 110*a*, and 110*b*) to operate implements as described in further detail herein.

The vehicle 100 may further include human machine interfaces (HMIs) 225. The HMIs 225 may include a driver demand pedal, a brake device (e.g., brake pedal), gear selector, implement control devices (e.g., implement joysticks, buttons, and the like), a touch interface, a graphical user interface (GUI), combinations thereof, and the like. Arrow 256 denotes the transfer of HMI data, such as data indicative of operator interaction with the input devices to request adjustment of selected vehicle components. For instance, the operator may request an increase in vehicle speed via driver demand pedal depression, a decrease in vehicle speed via brake pedal depression, extension of a boom via interaction with the implement control device. Thus, the VCU 240 may receive traction and implements adjustment requests from the HMIs 225.

The systems of FIGS. 1 and 2 provide for a vehicle system, comprising: a human/machine interface; a plurality of implement actuators; and a controller including instructions stored in non-transitory memory that when executed cause the controller to adjust an amount of power delivered to one or more of the plurality of implement actuators in response to an amount of power requested to operate the plurality of implement actuators as requested via input to the human/machine interface. In a first example, the vehicle system further comprises additional instructions to adjust the amount of power delivered to the one or more of the plurality of implement actuators in response to an implements power limit. In a second example that may include the first example, the vehicle system includes wherein the implements power limit is based on a transmission power request. In a third example that may include one or both of the first and second examples, the vehicle system includes wherein the human/machine interface includes a plurality of inputs to operate one or more implements via the plurality of implement actuators. In a fourth example that may include one or more of the first through third examples, the vehicle system includes wherein the amount of power requested to operate the plurality of implement actuators is based on the plurality of inputs to operate one or more implements via the plurality of implement actuators. In a fifth example that may include one or more of the first through fourth examples, the vehicle system includes wherein the amount of power requested to operate the plurality of implement actuators is further based on a pump speed and a pump displacement. In a sixth example that may include one or more of the first through fifth examples, the vehicle system includes wherein the amount of power requested to operate the plurality of implement actuators is further based on a pump supply pressure. In a seventh example that may include one or more of the first through sixth examples, the vehicle system further comprises additional instructions that cause the controller to determine a human/machine allowance factor. In an eighth example that may include one or more of the first through seventh examples, the vehicle system includes wherein the controller is a transmission control unit. In a ninth example that may include one or more of the first through eighth examples, the vehicle system includes wherein the transmission control unit is in electrical communication with a vehicle control unit. In a tenth example that may include one or more of the first through ninth examples, the vehicle system includes wherein the vehicle control unit is in electrical communication with a plurality of distributors, and wherein the plurality of distributors are in hydraulic communication with the plurality of implement actuators.

Referring now to FIG. 3, a high level block diagram 300 of a method for processing input from HMIs and commanding one or more implements is shown. The method may be at least partially implemented as executable instructions stored in memory of TCU 204 or another controller of vehicle 100. Further, the method may include actions taken in the physical world to transform an operating state of the system of FIGS. 1 and 2. Additionally, the method may provide at least portions of the operating sequence shown in FIG. 6.

VCU 240 receives HMI requests via HMIs 225 and VCU 240 passes the HMI requests to input 302*a* of power request calculation block 302 and input 306*b* of HMI command recalculation block 306. It may be understood that there are individual HMI requests from each of the HMIs even though HMI requests are shown via a single line. The power request calculation block 302 generates an implements requested power value that is based on an aggregate of HMI requests. The implements requested power value is passed to power manager input 304*a* and HMI command recalculation input 306*a*. Details of the power request calculation block are shown in FIG. 4. Power manager block 304 generates an implements power limit and the implements power limit is delivered from output 304*b* to input 306*c* of the HMI command recalculation block 306. The individual HMI requests and the implements requested power are directed to inputs 306*a* and 306*b* of the HMI command recalculation block 306 respectively. The HMI command recalculation block output 306*d* sends modified HMI requests back to VCU 240. VCU 240 commands the distributors of the implement actuation system 211 according to the modified HMI requests to operate the implements.

The power manager block 304 is designed to increase power distribution efficiency with regard to the transmission 206 and the implement actuation system 211. To that end, the power manager block 304 is configured to control (e.g., continuously control) a maximum power available for traction and implements taking into account the current power requests of the auxiliary component(s) and system(s), the available engine power, signals from HMIs that are generated responsive to operator interaction, system priorities that may be defined by the equipment manufacturers (e.g., the OEMs), as well as other factors. Further, by knowing the vehicle power request and the engine speed-power characteristics, the power manager block 304 may calculate a low (e.g., a minimum) target engine speed that achieves the power demands with low (e.g., minimum) fuel consumption.

In one example, the power manager block 304 splits the available net power from power source 212 based on a transmission power request, implements power request, and a priority value (P). The priority value may be the percentage of the maximum available net power to which the transmission is constrained. The priority value may be set or adjusted by the customer (e.g., OEM). In this way, a downstream vehicle manufacturer can select a power balance that is suited to their desire and/or the vehicle's end-use operating environment. The power balance selected by the customer may be expressed as a percentage allocated for the implements and for traction (e.g., 50% implements & 50% traction or 60% implements & 40% traction, etc.). The power manager block 304 may generate a transmission traction limit and an implements power limit that may expressed as a percentage of the maximum available net power. Further, the sum of the power limits for traction and the implements may be greater than 100%, in certain instances, because traction and implements may have a low chance of being simultaneously used at their maximum power during some conditions.

During some conditions, there is no power request for traction or implements. Under the no power request condition, the transmission power limit may be equal to a value of a variable P and the implements power limit may be equal to 100%−P.

In another example, where there is a transmission traction power request and no implement power request, the transmission traction power limit may be 100% and the implements power limit may be 100%−P. As such, the traction power may not be constrained by the implements when there is no power request coming from the implements.

In still another example, where there is an implements power request and no transmission traction power request, the transmission traction power limit may be P and the implements power limit may be 100%. In this way, the implements power may not be constrained by the traction power when there is not a traction power request.

Finally, where there are both an implements power request and transmission traction power request, which may be referred to as a combined maneuver, the transmission traction power limit may be 100%. Additionally, the implements power limit is calculation may be 100%−P+a controller term. The controller term may represent an output of a proportional integral (PI) controller. The output of the PI control aims to increase (e.g., maximize) engine load, thereby increasing engine efficiency by avoiding waste energy. However, in other examples, the PI controller term may be omitted from the implements power limit calculation when a mixed request is present. The aforementioned limits, in each of the different operating conditions blocks, may be continuously calculated during transmission operation and applied to the operation of the transmission for traction and implements operation. In this way, during combined maneuvers, the controlled power hand-over between the two power consumers is managed to reduce the likelihood of engine overload during transients. Further, the customer (e.g., OEM) may be allowed to set the priorities for implements and traction, specifically during the combined maneuver. As such, the customer is allowed to tailor the power balance between traction and implements according to their predilection, thereby increasing customer satisfaction. The power manager block 304 directs the implements power limit from output 304*b* to input 306*c* of the HMI command recalculation block 306.

Referring now to FIG. 4, a block diagram 400 of a method to generate requested power for implements of a vehicle is shown. The block diagram of FIG. 4 represents the internals of block 302 of FIG. 3. The method of FIG. 4 may be at least partially implemented as executable instructions stored in memory of TCU 204 or another controller of vehicle 100. Further, the method of FIG. 4 may include actions taken in the physical world to transform an operating state of the system of FIGS. 1 and 2. The method of FIG. 4 may operate in cooperation with the methods of FIGS. 3 and 5. Additionally, the method of FIG. 4 may provide at least portions of the operating sequence shown in FIG. 6.

HMI requests are received at input 302*a* and distributed to inputs 404*a*-410*a* of flow rate calculation blocks 404-410. The HMI requests may be input as voltage signals, electric current signals, or numeric values. In one example, each of flow rate calculation blocks include a relationship between an HMI request value and a hydraulic fluid flow rate. For example, if the first HMI request is for advancing a telescopic boom and the HMI request is manifest as 10 milliamps of electric current, a relationship between electric current and a flow rate to the actuators of the telescopic boom is used to look-up a hydraulic fluid flow rate according to the 10 milliamps of electric current. Block 404 outputs a flow rate of hydraulic fluid via output 404*b* to summing junction 412. Similarly, hydraulic fluid flow rates are provided from outputs 406*b*-410*b* of blocks 406-410 to summing junction 412. Summing junction 412 adds all of the hydraulic fluid flow rates (e.g., flow rates from each and every one of the HMI requests) and supplies the summed flow rate to input 414*b* of processing block 414.

A speed of pump 221 is input to multiplication block 402 at input 402*a*. In addition, a displacement of pump 221 is input to multiplication block 402 at input 402*b*. The multiplied result of pump speed and pump displacement is a maximum flow rate of the pump and it is directed from output 402*c* to input 414*a* of processing block 414.

In one example, processing block 414 may determine a lesser value of input 414*a* and 414*b* to generate a total feasible flow rate for the hydraulic system, which includes pump 221, distributors (e.g., 120*a*, 120*b*, 104*a*, 104*b*, 110*a*, and 110*b*), and hydraulic cylinders (e.g., 120, 104, and 110). The total feasible value is directed from output 414*c* to input 416*b* of multiplication block 416. A supply pressure (e.g., pressure at the output of pump 221) is provided to input 416*a* of multiplication block 416. Multiplication block 416 multiplies the supply pressure and the feasible flow rate to generate a total requested power for implements. The total requested output for implements is directed from output 302*b* to input 306*a* of the HMI command recalculation block.

Referring now to FIG. 5, a block diagram 500 of a method to recalculate HMI commands for implements of a vehicle is shown. The block diagram of FIG. 5 represents the internals of block 306 of FIG. 3. The method of FIG. 5 may be at least partially implemented as executable instructions stored in memory of TCU 204 or another controller of vehicle 100. Further, the method of FIG. 5 may include actions taken in the physical world to transform an operating state of the system of FIGS. 1 and 2. The method of FIG. 5 may operate in cooperation with the methods of FIGS. 3 and 4. Additionally, the method of FIG. 5 may provide at least portions of the operating sequence shown in FIG. 6.

The implements power limit value is received at input 306*c* of division block 502. The implements power requested value is received at input 306*a* of division block 502. Division block 502 divides the implements power limit value by the implements power requested value to generate a HMI allowance factor. The HMI allowance factor is directed from output 502*c* to input 504*a* of minimum block 504. A value of one is input to input 504*b* of the minimum block 504. Minimum block 504 determines a minimum of the value at input 504*a* and the value at input 504*b* to generate a HMI allowance factor. The minimum value (e.g., HMI allowance factor) is directed from output 504*c* to inputs 506*b*, 508*b*, 510*b*, and 512*b* of multiplication blocks 506-512.

HMI requests are received at input 306*b* and distributed to inputs 506*a*-512*a* of multiplication blocks 506-512. Multiplication blocks 506-512 multiply each of the unmodified individual HMI requests by the HMI allowance factor to generate modified HMI requests for each of the HMIs. The modified HMIs are directed from outputs 506*c*-512*c* to output 306*d* before being sent to the VCU 240. The VCU 240 commands the implement actuators via the modified HMIs. The modified HMIs may be sent out via a communications link (e.g., a controller area network or via individual conductors) to VCU 240 as indicated via output 306*d* and VCU 240 commands to distributors, which controls flow of hydraulic fluid to the hydraulic cylinders, thereby controlling the implements.

Thus, the HMI command recalculation block 306 rescales the HMI requests according to an HMI allowance value that is based on an implements power limit. All HMI requests are processed simultaneously so that the total power that is requested via HMIs may be considered when recalculating the HMI requests.

Referring now to FIG. 6, a prophetic vehicle operating sequence is shown. The operating sequence of FIG. 6 may be provided via the system of FIGS. 1 and 2 in cooperation with the methods of FIGS. 3-5. The vertical lines at times t0-t8 represent times of interest during the operating sequence. The plots are time aligned.

The first plot from the top of FIG. 6 is a plot of a transmission traction power request versus time. The vertical axis represents the transmission traction power request and the transmission power request value increases in the direction of the vertical axis arrow. The horizontal axis represents time and time increases from the left side of the plot to the right side of the plot. Trace 602 represents the transmission traction power request. The transmission traction power request may be based on a position of a driver demand pedal.

The second plot from the top of FIG. 6 is a plot of a first implement power flow request versus time. The vertical axis represents the first implement power flow request and the value of the first implement power flow request increases in the direction of the vertical axis arrow. The horizontal axis represents time and time increases from the left side of the plot to the right side of the plot. Trace 604 represents the first implement power flow request.

The third plot from the top of FIG. 6 is a plot of a second implement power flow request versus time. The vertical axis represents the second implement power flow request and the value of the second implement power flow request increases in the direction of the vertical axis arrow. The horizontal axis represents time and time increases from the left side of the plot to the right side of the plot. Trace 606 represents the second implement power flow request.

The fourth plot from the top of FIG. 6 is a plot of a third implement power flow request versus time. The vertical axis represents the third implement power flow request and the value of the third implement power flow request increases in the direction of the vertical axis arrow. The horizontal axis represents time and time increases from the left side of the plot to the right side of the plot. Trace 608 represents the third implement power flow request.

The fifth plot from the top of FIG. 6 is a plot of the implements power flow request (e.g., a sum of power request for all implements) versus time. The vertical axis represents the implements power flow request and the value of the implements power flow request increases in the direction of the vertical axis arrow. The horizontal axis represents time and time increases from the left side of the plot to the right side of the plot. Trace 610 represents the implements power flow request.

The sixth plot from the top of FIG. 6 is a plot of an implements power flow limit versus time. The vertical axis represents the implement power flow limit and the value of the implement power flow limit increases in the direction of the vertical axis arrow. The horizontal axis represents time and time increases from the left side of the plot to the right side of the plot. Trace 612 represents the implement power flow limit.

The seventh plot from the top of FIG. 6 is a plot of a first implement power flow allowed percentage versus time. The vertical axis represents the first implement power flow allowed percentage and the first implement power flow allowed percentage increases in the direction of the vertical axis arrow. The horizontal axis represents time and time increases from the left side of the plot to the right side of the plot. Trace 614 represents the first implement power flow allowed percentage.

The eighth plot from the top of FIG. 6 is a plot of a second implement power flow allowed percentage versus time. The vertical axis represents the second implement power flow allowed percentage and the value of the second implement power flow allowed percentage increases in the direction of the vertical axis arrow. The horizontal axis represents time and time increases from the left side of the plot to the right side of the plot. Trace 616 represents the second implement power flow allowed percentage.

The ninth plot from the top of FIG. 6 is a plot of a third implement power flow allowed percentage versus time. The vertical axis represents the third implement power flow allowed percentage and the value of the third implement power flow allowed percentage increases in the direction of the vertical axis arrow. The horizontal axis represents time and time increases from the left side of the plot to the right side of the plot. Trace 618 represents the third implement power flow allowed percentage.

At time t0, the transmission traction power request is zero and each of the implements power requests are zero. Consequently, the implements power request is zero. The implements power limit is a high value and the implement power flow allowed percentage for each of the implements is zero.

At time t1, the transmission traction power request begins to increase and the implements power limit is reduced in response to the increasing transmission traction power request. Each of the implements power requests are still zero. Likewise, the implements power request is zero. The implement power flow allowed percentage for each of the implements remains zero.

At time t2, power flow requests for the first and second implements begins to increase and the implements power request increases with the first and second implements requests. However, the implements power limit has been reduced so the implement power flow allowed percentage for the first and second implements is less than the implements power flow requests for the first and second implements. Thus, power flow to the implements is allowed, but it has been cut back from what has been requested since some engine power will support the transmission traction power request.

At time t3, power flow requests for the first and second implements begins to decrease and the implements power request decreases with the first and second implements requests. The implements power limit is still at a lower level so the implement power flow allowed percentage for the first and second implements decreases with the decreasing requests for power flow to the first and second implements.

At time t4, the transmission traction power request begins to decrease and the implements power limit is increased in response to the decreasing transmission traction power request. Each of the implements power requests are zero. Additionally, the implements power request is zero. The implement power flow allowed percentage for each of the implements remains zero.

At time t5, power flow request for the first implement begins to increase and the implements power request increases with the first implement request. The implements power limit has not been reduced so the implement power flow allowed percentage for the first implement follows the first implement power flow request. Thus, power flow to the implements is allowed and it is unencumbered by the implements power limit.

At time t6, power flow request for the third implement begins to increase and the implements power request increases with the third implement request. The implements power limit has not been reduced so the implement power flow allowed percentage for the first and third implements follows the implement power flow requests for the first and third implements. As a result, power flow to the first and third implements is allowed and it is unencumbered by the implements power limit.

At time t7, power flow requests for the third implement begins to decrease and the implements power request decreases with the third implement request. The implements power limit is still at a high level. The implement power flow allowed percentage for the third implement decreases and implement power flow allowed percentage for the first implement is unchanged.

At time t8, power flow requests for the first implement begins to decrease and the implements power request decreases with the first implement request. The implements power limit is still at a high level. The implement power flow allowed percentage for the first implement decreases and implement power flow allowed percentage for the third implement has reached zero.

In this way, power flow to implements may be scaled according to a transmission traction power request so that a vehicle may travel when requested even if there are implement power flow requests. The implement power flow requests may be limited based on an implements power limit.

Thus, the methods of FIGS. 3-5 may provide for a method for operating implements of a vehicle, comprising: receiving data from one or more implement inputs of a human/machine interface to a controller; and adjusting operation of one or more distributors via the controller in response to a requested power, wherein the requested power is based on the data from all or each and every one of the one or more implement inputs of the human/machine interface. In a first example, the method includes wherein human/machine interface is a joystick. In a second example that may include the first example, the method includes wherein the requested power is further based on a pump speed, a pump displacement, and a supply pressure. In a third example that may include one or both of the first and second examples, the method further comprises adjusting distributor commands generated via the controller in response to a human/machine interface allowance factor.

The methods of FIGS. 3-5 also provide for a method for operating implements of a vehicle, comprising: scaling one or more implement request values in response to a human/machine interface allowance factor via a controller, wherein the human/machine interface allowance factor is based on an implements power limit divided by an implements requested power value. In a first example, the method further comprises determining the implements requested power value via adding a plurality of implement request values. In a second example that may include the first example, the method includes wherein the implements requested power value is further based on a pump speed, a pump displacement, and a supply pressure. In a third example that may include one or both of the first and second examples, the method includes wherein the plurality of implement request values are based on inputs to a human/machine interface. In a fourth example that may include one or more of the first through third examples, the method includes wherein the implements power limit is based on a transmission power request.

Referring now to FIG. 7, an illustration of an example joystick 700 is shown. In this example, joystick 700 may be configured to move back and forth as indicated by arrow 702 to request longitudinal motion of an implement. Joystick 700 may also move left and right as indicated by arrow 704 to request lateral motion of an implement. Joystick 700 is shown with a left thumb lever 708 and a right thumb lever 706. Left thumb lever 708 may be applied to request two direction motion of an implement that is different than the implement that is moved when joystick 700 is moved as indicated by arrows 702 and 704. Similarly, right thumb lever 706 may be applied to request two direction motion of an implement that is different than the implement that is moved when joystick 700 is moved as indicated by arrows 702 and 704 and when right thumb lever 706 is moved.

Referring now to FIG. 8, an illustration of an example driver demand pedal 800 is shown. Driver demand pedal 800 may be applied via human 802 and the position of driver demand pedal 800 may be determined via sensor 804. A position of driver demand pedal 800 may be converted into a driver demand torque or power.

Referring now to FIG. 9, an illustration of an example brake pedal 900 is shown. Brake pedal 900 may be applied via human 802 and the position of brake pedal 900 may be determined via sensor 902. A position of brake pedal 900 may be converted into a braking torque or power.

Note that the example control and estimation routines included herein can be used with various powertrain and/or vehicle system configurations. The control methods and routines disclosed herein may be stored as executable instructions in non-transitory memory and may be carried out by the control system including the controller in combination with the various sensors, actuators, and other transmission and/or vehicle hardware. Further, portions of the methods may be physical actions taken in the real world to change a state of a device. Thus, the described actions, operations and/or functions may graphically represent code to be programmed into non-transitory memory of the computer readable storage medium in the vehicle and/or transmission control system. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. One or more of the method steps described herein may be omitted if desired.

While various embodiments have been described above, it is to be understood that they have been presented by way of example, and not limitation. It will be apparent to persons skilled in the relevant arts that the disclosed subject matter may be embodied in other specific forms without departing from the spirit of the subject matter. The embodiments described above are therefore to be considered in all respects as illustrative, not restrictive. As such, the configurations and routines disclosed herein are exemplary in nature, and that these specific examples are not to be considered in a limiting sense, because numerous variations are possible. For example, the above technology can be applied to powertrains that include different types of propulsion sources including different types of electric machines, internal combustion engines, and/or transmissions. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims may be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A vehicle system, comprising:

a human/machine interface;

a plurality of implement actuators; and a controller including instructions stored in non-transitory memory that when executed cause the controller to adjust an amount of power delivered to one or more of the plurality of implement actuators in response to an amount of power requested to operate the plurality of implement actuators as requested via input to the human/machine interface, wherein the human/machine interface includes a plurality of inputs to operate one or more implements via the plurality of implement actuators, wherein the amount of power requested to operate the plurality of implement actuators is based on the plurality of inputs to operate one or more implements via the plurality of implement actuators, and wherein the amount of power requested to operate the plurality of implement actuators is further based on a pump speed and a pump displacement.

2. The vehicle system of claim 1, further comprising additional instructions to adjust the amount of power delivered to the one or more of the plurality of implement actuators in response to an implements power limit.

3. The vehicle system of claim 2, wherein the implements power limit is based on a transmission power request.

4. The vehicle system of claim 1, wherein the amount of power requested to operate the plurality of implement actuators is further based on a pump supply pressure.

5. The vehicle system of claim 1, further comprising additional instructions that cause the controller to determine a human/machine allowance factor.

6. The vehicle system of claim 1, wherein the controller is a transmission control unit.

7. The vehicle system of claim 6, wherein the transmission control unit is in electrical communication with a vehicle control unit.

8. The vehicle system of claim 7, wherein the vehicle control unit is in electrical communication with a plurality of distributors, and wherein the plurality of distributors are in hydraulic communication with the plurality of implement actuators.

9. A method for operating implements of a vehicle, comprising:

receiving data from one or more implement inputs of a human/machine interface to a controller; and adjusting operation of one or more distributors via the controller in response to a requested power, wherein the requested power is based on the data from the one or more implement inputs of the human/machine interface, and wherein the requested power is further based on a pump speed, a pump displacement, and a supply pressure.

10. The method of claim 9, wherein human/machine interface is a joystick.

11. The method of claim 9, further comprising adjusting distributor commands generated via the controller in response to a human/machine interface allowance factor.

12. A method for operating implements of a vehicle, comprising:

scaling one or more implement request values in response to a human/machine interface allowance factor via a controller, wherein the human/machine interface allowance factor is based on an implements power limit divided by an implements requested power value.

13. The method of claim 12, further comprising determining the implements requested power value via adding a plurality of implement request values.

14. The method of claim 13, wherein the implements requested power value is further based on a pump speed, a pump displacement, and a supply pressure.

15. The method of claim 14, wherein the plurality of implement request values are based on inputs to a human/machine interface.

16. The method of claim 15, wherein the implements power limit is based on a transmission power request.

* * * * *